US006099370A

United States Patent [19]

Tanaka et al.

[11] Patent Number: 6,099,370

[45] Date of Patent: Aug. 8, 2000

[54] POWER TRANSMISSION ARRANGEMENT FOR AN OUTBOARD MARINE DRIVE

[75] Inventors: Mitsuharu Tanaka; Tomonori Ikuma; Hiroshi Mizuguchi, all of Wako, Japan

[73] Assignee: Honda Giken Kogyo Kabushiki Kaisha, Tokyo, Japan

[21] Appl. No.: 09/151,596

[22] Filed: Sep. 11, 1998

[30] Foreign Application Priority Data

Sep. 12, 1997 [JP] Japan ..... 9-249159

[51] Int. Cl.[7] ..... B63H 20/14

[52] U.S. Cl. ..... 440/75

[58] Field of Search ..... 440/75

[56] References Cited

U.S. PATENT DOCUMENTS 4,378,219 3/1983 Tanaka ..... 440/75

4,841,929 6/1989 Tuggle et al. ..... 123/198

FOREIGN PATENT DOCUMENTS 60-24714 7/1985 Japan .

*Primary Examiner*—S. Joseph Morano

*Assistant Examiner*—Andrew D. Wright

*Attorney, Agent, or Firm*—Skjerven, Morrill, MacPherson, Franklin & Friel LLP; Alan H. MacPherson

[57] ABSTRACT

In an outboard marine drive including a vertically oriented engine, a disk member is attached to a lower end of the crankshaft of the engine, and the upper end of the drive shaft is disposed coaxially with respect to the crankshaft and at a prescribed distance from the disk member so that a direct coupling member and an centrifugal clutch device may be interchangeably installed between them. The disk member is provided with axial holes for either pivotally supporting clutch shoes or fixedly attaching the upper end of the direct coupling member. The lower end of the direct coupling member and the clutch drum of the centrifugal clutch device are provided with an identical coupling arrangement for coupling with an upper end of the drive shaft.

4 Claims, 3 Drawing Sheets

POWER TRANSMISSION ARRANGEMENT FOR AN OUTBOARD MARINE DRIVE

TECHNICAL FIELD

The present invention relates to a power transmission arrangement for an outboard marine drive, and in particular to such an arrangement which can be readily adapted to different configurations.

BACKGROUND OF THE TTHEE INVENTION

In small outboard marine drives, with the aim of simplifying the structure and reducing the weight, the power output from the engine is directly transmitted to the propeller via a drive shaft. However, when it is desired to propel the boat or other watercraft at a relatively low speed, for instance for troll fishing, it is necessary to install a clutch in the path of power transmission from the engine to the propeller. Japanese UM publication (kokoku) No. 60-24714 discloses a small outboard marine drive incorporated with a centrifugal clutch which is interposed between a lower end of a crankshaft of a vertically oriented engine and an upper end of a drive shaft. The centrifugal clutch engages when the rotational speed of the engine is higher than a certain level, and disengages when the rotational speed drops below this level.

However, some consumers may wish to have such a centrifugal clutch, but others may not need it. Elimination of a centrifugal clutch will simplify the structure of the outboard marine drive, and make it lighter in weight and more economical. Also, from the manufacturer's view point, adapting the production facilities to two different models increases the efforts required for production management and the number and variety of component parts that need to be stocked. The distributor also suffers because he needs to keep two models in stock.

Based on such considerations, the inventors have realized that, to meet the need of a widest range of consumers, it is desirable for the outboard marine drive to be readily converted between a model equipped with a centrifugal clutch and another model not equipped with a centrifugal clutch.

BRIEF SUMMARY OF THE INVENTION

In view of such problems of the prior art and the recognition by the inventors, a primary object of the present invention is to provide an outboard marine drive which can be readily converted between a model equipped with a centrifugal clutch and a model not equipped with a centrifugal clutch.

A second object of the present invention is to provide an outboard marine drive which can be converted between a model equipped with a centrifugal clutch and a model not equipped with a centrifugal clutch so readily that the conversion can be made at a distributor or a centrifugal clutch may be retrofitted into a model originally not equipped with a clutch, and vice versa.

A third object of the present invention is to provide an outboard marine drive which can be adapted to both a model equipped with a centrifugal clutch and a model not equipped with a centrifugal clutch without complicating the structure or otherwise impairing the performance or increasing the cost of the outboard marine drive.

According to the present invention, these and other objects can be accomplished by providing a power transmission arrangement for transmitting output power from a crankshaft of a vertically oriented engine in an outboard marine drive, comprising: a disk member fixedly attached to a lower end of the crankshaft, the disk member being provided with a plurality of axial mounting holes passed axially therein and arranged coaxially and at a regular angular interval around an axial center of the disk member; a drive shaft which is rotatably supported in a coaxial relationship to the crankshaft, and having an upper end at a prescribed distance from the disk member; and power transmitting means interposed between the disk member and the upper end of the drive shaft; wherein the power transmitting means being interchangeably selected from a centrifugal clutch device and a direct coupling member; the centrifugal clutch device including a plurality of clutch shoes each having a base end pivotally supported by a threaded bolt passed into a corresponding one of the mounting holes of the disk member, a spring member urging free ends of the clutch shoes in radially inward direction, a clutch drum coaxially and rotatably supported by a cup-shaped clutch housing attached to a lower end of the engine so as to be engaged by the clutch shoes when a rotational speed of the disk member exceeds a certain level, and a coupling formed in a part of the clutch drum for rotatively coupling the upper end of the drive shaft with the clutch drum; the direct coupling member including a coupling for rotatively coupling the upper end of the drive shaft with the direct coupling member, and an integral flange through which threaded bolts are passed into the mounting holes of the disk member.

Thus, the mounting holes formed in the disk member can be used for either pivotally supporting the clutch shoes or fixedly securing an upper end of the direct coupling member, and the upper end of the drive shaft likewise can be rotatably coupled with either the lower end of the direct coupling member or the lower end of the clutch drum. Therefore, the outboard marine drive can be adapted to a direct coupling model or a centrifugal clutch model without any significant modification. The coupling for the upper end of the drive shaft may consist of a spline coupling, and the mounting holes of the disk member may simply consist of threaded holes.

According to a preferred embodiment of the present invention, the extension case is attached to the lower end of the clutch housing. According to this arrangement, the upper end of the drive shaft can be coupled with either the direct coupling member or the clutch drum simply by passing the upper end of the drive shaft into the clutch housing while securing the extension case to the clutch housing.

BRIEF DESCRIPTION OF THE DRAWINGS

Now the present invention is described in the following with reference to the appended drawings, in which:

FIG. 3 is a view similar to FIG. 2 when the outboard marine drive is fitted with a direct coupling member.

DETAILED DESCRIPTION OF THE PREFERRED EMBODIMENTS

Figure 1:
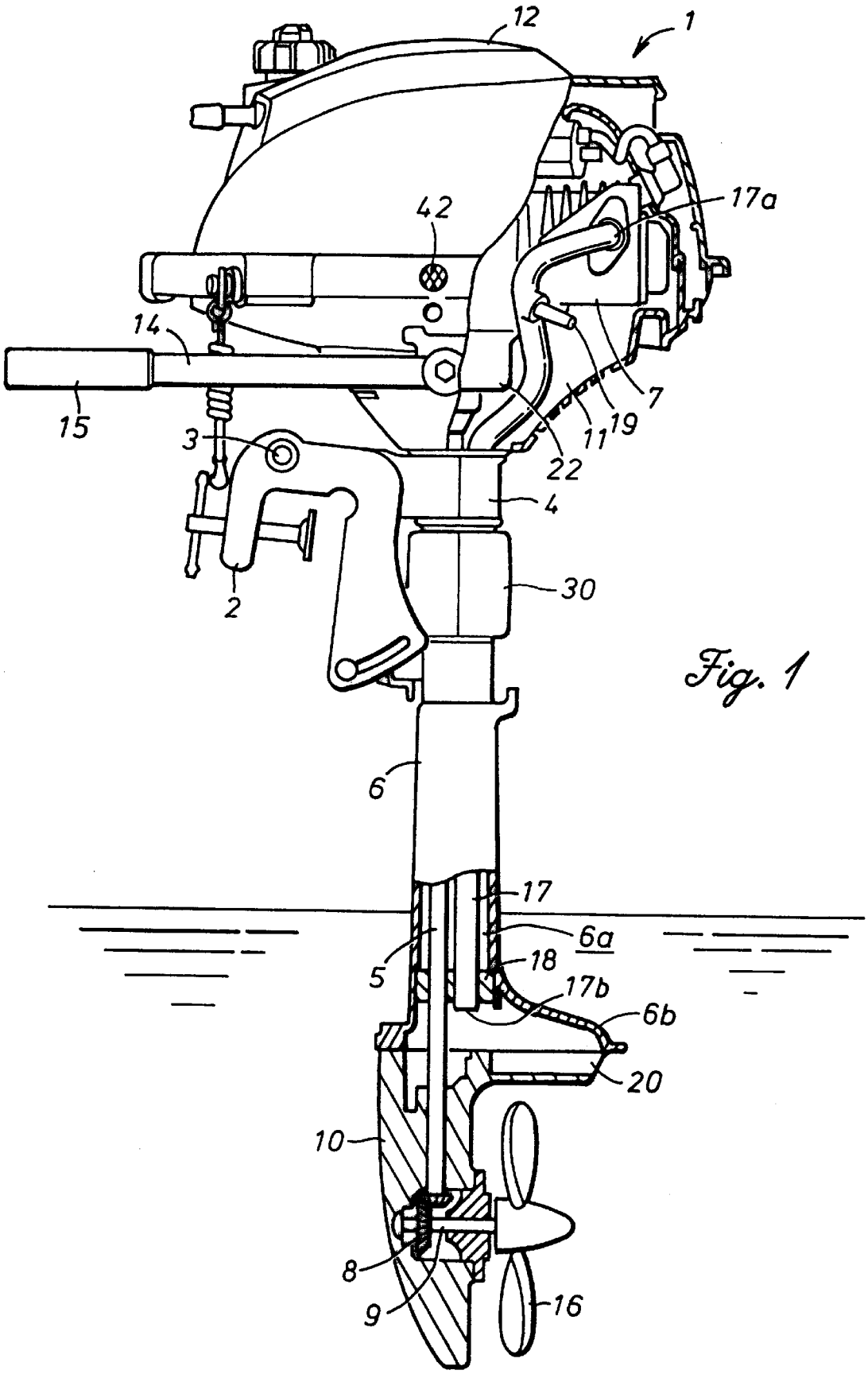
FIG. 1 is a partly broken-away side view of an outboard marine drive embodying the present invention.

FIG. 1 generally illustrates a side view of an outboard marine drive embodying the present invention. This outboard marine drive 1 is adapted to be attached to a transom of a boat (not shown in the drawing) with a stem bracket 2 having a clamping capability. To the stem bracket 2 is attached a swivel case 4 via a tilt shaft 3 extending horizontally across the width of the boat. The swivel case 4 in turn supports a tubular extension case 6 accommodating therein a vertically extending drive shaft 5. The swivel case 4 permits the main part of the outboard marine drive to rotate 360 degrees around a vertical steering axis relative to the stem bracket 2 or the boat.

The upper end of the extension case 6 is attached to an internal combustion engine 7, and the lower end 6*b* of the extension case 6 is attached to a gear case 10 accommodating, a propeller shaft 9 and a bevel gear mechanism 8 for transmitting the rotative power from the lower end of the drive shaft 5 to the propeller shaft 9.

The engine 7 consists of a vertical-crankshaft, air-cooled, single-cylinder, four-stroke internal combustion engine, and is generally covered by an under case 11 and an engine cover 12 which are detachably joined with each other. The cylinder head of this engine is directed rearward with a slight angular offset to one side. The lower end of a crankshaft 23 (FIG. 2) of this engine 7 is connected to the upper end of the drive shaft 5 via a known centrifugal clutch device 13. The under case 11 is attached to the bottom surface of a housing of the centrifugal clutch device 13 so that the engine cover 12 may be removed while the under case 11 is kept attached to the engine 7.

The housing 22 of the centrifugal clutch device 13 is provided with an arm (not shown in the drawings) which extends out of the under case 11, and a free end of this arm is attached to a steering arm 14 which can turn in a horizontal plane. By thus angularly moving the steering arm 14, the outboard marine drive main body can be turned around a vertical axis for steering the boat. A free end of the steering arm 14 is provided with a throttle grip 15 for operating a throttle valve of a carburetor (not shown in the drawing). When the rotational speed of the engine 7 is increased beyond a certain level by suitably twisting the throttle grip 15, the centrifugal clutch device 13 is engaged, and the rotational power of the crankshaft is transmitted to the propeller 16 via the drive shaft 5 and the propeller shaft 9.

An exhaust pipe 17 has an upper end 17*a* which is connected to an exhaust port of the cylinder block, and extends from the engine room into the extension case 6 along a curved path. The lower end 17*b* of the exhaust pipe 17 terminates at a point adjacent to the lower end 6*b* of the extension case 6. The exhaust pipe 17 extends substantially in parallel with the drive shaft 5 inside the extension case 6, and its lower end 17*b* is supported by a circular partition member 18 which is made of resilient elastomeric material and fitted into a bore defined at the lower end 6*b* of the extension case 6. An inlet opening 19 is provided in a curved part of the exhaust pipe 17 adjacent to the cylinder block for receiving a probe for analyzing the contents of the exhaust gas.

The exhaust gas from the engine 7 is released from the lower end 17*b* of the exhaust pipe 17, and is normally released into the water from an opening 20 defined in the interface between the extension case 6 and the gear case 10. The exhaust gas is then pushed rearward in the water by the water flow produced by the propeller 16. Because the interior 6*a* of the extension case 6 is separated from the lower part thereof by the partition member 18, the exhaust gas is prevented from flowing upward inside the extension case 6.

Figure 2:
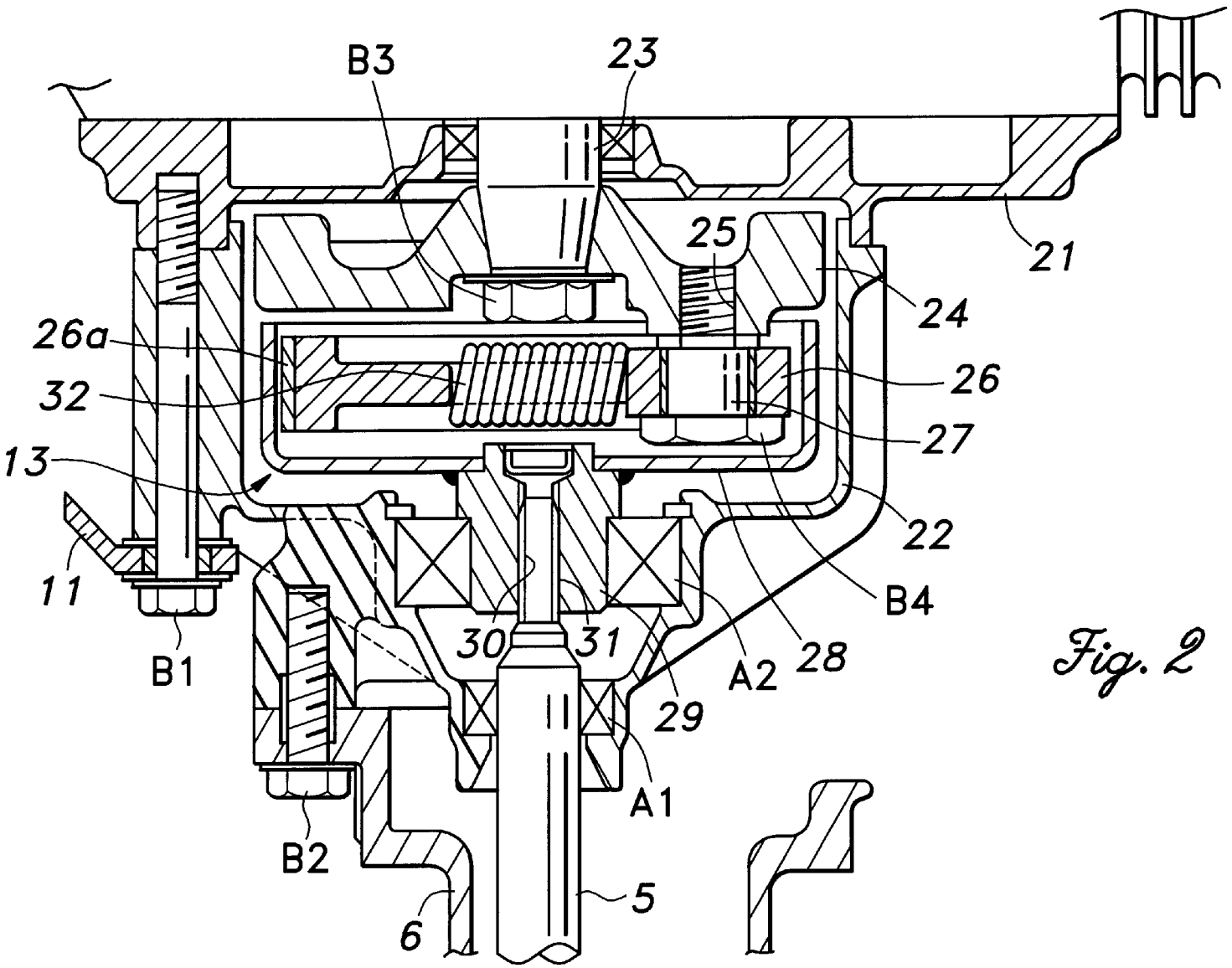
FIG. 2 is a fragmentary sectional view of the power transmitting arrangement when the outboard marine drive is fitted with a centrifugal clutch device.
Figure 9:
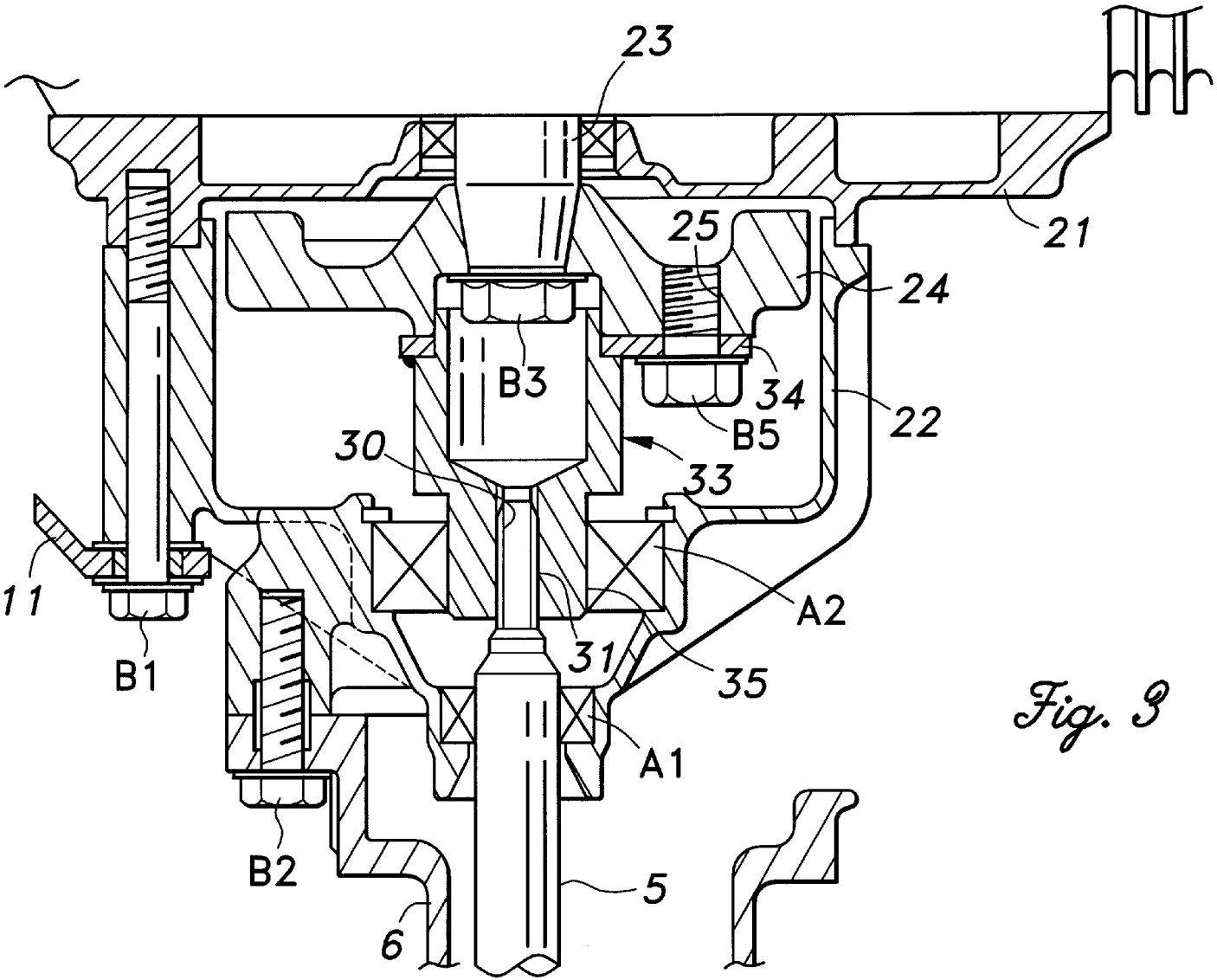

Referring to FIG. 2, a disk member 24 serving also as a part of the flywheel for the engine is coaxially attached to a lower end of the crankshaft 23 by threading a nut B3 to a threaded end of the crankshaft 23. This disk member 24 is provided with three threaded axial holes 25 arranged concentrically at an equal angular interval. The cup-shaped clutch housing 22 is attached to a lower end surface of the crankcase 21 of the engine 7 by using threaded bolts B1. The upper end of the extension case 6 is attached to the bottom end of the clutch housing 22 by using threaded bolts B2. The upper end of the drive shaft 5 is passed into the clutch housing 22 via a bearing A1.

Inside the clutch housing 22, each of the threaded axial holes 25 of the disk member 24 receives a threaded bolt B4 which pivotally supports a base end of a clutch shoe 26 via a pin member 27. The upper end of the drive shaft 5 is formed as a splined end which is fitted into a complimentary splined hole 30 of a stub shaft 29 which is rotatably and coaxially supported by a lower part of the clutch housing 22 via a bearing A2. The upper end of this stub shaft 29 is integrally and coaxially attached to a bottom end of a clutch drum 28. Each of the clutch shoes 26 is normally urged by a tension coil spring 32 in such a direction as to pull a clutch lining 26*a* placed on a free end of each of the clutch shoes 26 away from the opposing surface of the clutch drum 28. As the rotational speed of the engine increases, the clutch shoes 26 are forced radially away from the axial center by the centrifugal force against the spring force of the tension coil springs 32. When the rotational speed of the engine increases beyond a certain level, the resulting centrifugal force acting upon the clutch shoes 26 forces the clutch lining 26*a* into engagement with the opposing surface of the clutch drum 28 against the spring force of the tension coil springs 32 with the result that the rotative power of the crankshaft 23 is transmitted to the drive shaft 5.

When the outboard marine drive is desired to be assembled as a directly coupled model instead of the above described model equipped with a centrifugal clutch device 13, in place of the clutch shoes 26 attached to the disk member 24 via the pin members 27, a direct coupling member 33 is fixedly secured to the disk member 24, as illustrated in FIG. 3, by passing threaded bolts B5 through a flange 34 of the direct coupling member 33 into the threaded holes 25 of the disk member 24. The splined upper end 31 of the drive shaft 5 is fitted into a corresponding splined hole 30 formed in the direct coupling member 33 instead of the similar splined hole 30 of the clutch drum 28 illustrated in FIG. 2. Because the direct coupling member 33 is dimensioned so as to be compatible with the axial dimension between the upper end of the drive shaft 5 and the disk member 24 which is selected so as to accommodate the centrifugal clutch device 13, it is possible to assemble the outboard marine drive as a direct coupling model simply installing the direct coupling member 33 instead of the centrifugal clutch device 13.

Thus, the present invention allows the outboard marine drive to be assembled as a direct coupling model or a centrifugal clutch model simply by selectively installing either a centrifugal clutch device or a direct coupling member. It is also possible to change from one model to another by a distributor or even by a user. For instance, a user can retro-fit a centrifugal clutch device into a outboard marina drive which was originally purchased as a direct coupling model without any significant difficulty.

Although the present invention has been described in terms of a preferred embodiment thereof, it is obvious to a person skilled in the art that various alterations and modifications are possible without departing from the scope of the present invention which is set forth in the appended claims.

What is claimed is:

1. A power transmission arrangement for transmitting output power from a crankshaft of a vertically oriented engine in an outboard marine drive, comprising:

a disk member fixedly attached to a lower end of said crankshaft, said disk member being provided with a plurality of axial mounting holes passed axially therein and arranged coaxially and at a regular angular interval around an axial center of said disk member;

a drive shaft which is rotatably supported in a coaxial relationship to said crankshaft, and having an upper end at a prescribed distance from said disk member; and power transmitting means interposed between said disk member and said upper end of said drive shaft;

said power transmitting means being interchangeably selected from a centrifugal clutch device and a direct coupling member;

said centrifugal clutch device including a plurality of clutch shoes each having a base end pivotally supported by a threaded bolt passed into a corresponding one of said mounting holes of said disk member, a spring member urging free ends of said clutch shoes in radially inward direction, a clutch drum coaxially and rotatably supported by a cup-shaped clutch housing attached to a lower end of said engine so as to be engaged by said clutch shoes when a rotational speed of said disk member exceeds a certain level, and a coupling formed in a part of said clutch drum for rotatively coupling said upper end of said drive shaft with said clutch drum;

said direct coupling member including a coupling for rotatively coupling said upper end of said drive shaft with said direct coupling member, and an integral flange through which threaded bolts are passed into said mounting holes of said disk member.

2. A power transmission arrangement for an outboard marine drive according to claim 1 wherein said coupling comprises a splined upper end of said drive shaft and a complementary splined hole formed in each of said clutch drum and said direct coupling member.

3. A power transmission arrangement for an outboard marine drive according to claim 1, wherein said axial mounting holes comprise threaded holes.

4. A power transmission arrangement for an outboard marine drive according to claim 1, wherein an extension case is attached to a lower end of said clutch housing.

* * * * *